United States Patent [19]

Kennedy et al.

[11] 4,312,538

[45] Jan. 26, 1982

[54] ARTICULATING HEADREST

[75] Inventors: Joe H. Kennedy; James H. Broadhead, both of Bay Minette, Ala.

[73] Assignee: Syntex (U.S.A.) Inc., Palo Alto, Calif.

[21] Appl. No.: 83,735

[22] Filed: Oct. 10, 1979

[51] Int. Cl.[3] ..... A47C 7/38; A61G 15/00

[52] U.S. Cl. ..... 297/408; 297/375

[58] Field of Search ..... 297/375, 408, 328, 397

[56] References Cited

U.S. PATENT DOCUMENTS

| | | | |
|---|---|---|---|
| 1,542,508 | 6/1925 | Koenigkramer | 297/328 X |
| 1,629,306 | 5/1927 | Reeder | 297/408 |
| 1,810,134 | 6/1931 | Emmert | 297/375 X |
| 2,662,585 | 12/1953 | Ozenne | 297/375 |
| 2,925,854 | 2/1960 | Fidel | 297/328 |
| 3,135,550 | 6/1964 | Bosack | 297/329 |
| 3,207,549 | 9/1965 | Posh | 297/216 |
| 3,817,576 | 6/1974 | Ciavattoni et al. | 297/408 |
| 4,191,423 | 3/1980 | Goldner | 297/408 |

FOREIGN PATENT DOCUMENTS

| | | | |
|---|---|---|---|
| 803554 | 4/1951 | Fed. Rep. of Germany | 297/375 |

*Primary Examiner*—Francis K. Zugel

*Attorney, Agent, or Firm*—John A. Dhuey; Joseph I. Hirsch

[57] ABSTRACT

An articulating headrest for a dental chair having a unidirectional locking means is described. The locking means comprises a locking plate engageable with a pivotable shaft connected to a headrest support means. The locking means is adapted to one-handed operation by an operator and permits unhindered forward rotational movement of the headrest about the support means in order to prevent accidental jamming of the headrest against an object during downward movement of the dental chair.

14 Claims, 6 Drawing Figures

ARTICULATING HEADREST

BACKGROUND OF THE INVENTION

1. Field of the Invention

The present invention relates to an articulating headrest for use with chairs, specifically dental chairs, and to a headrest which may be operated with one hand and which exhibits unhindered movement in a forward direction and restricted movement in a backward direction relative to the backrest of the chair to which it is attached.

2. State of the Art

The positioning of a headrest on a medical or dental chair relative to a patient's head has been considered previously. For example, U.S. Pat. No. 4,111,483 (Jaeger), U.S. Pat. No. 4,111,484 (Jaeger) and U.S. Pat. No. 4,128,274 (Schmedemann) are directed primarily to the vertical positioning of a headrest relative to a patient's head. The Schmedemann patent also discloses methods for the horizontal positioning of a headrest.

While vertically and horizontally adjustable headrests generally can increase patient comfort upon proper positioning, such devices are not entirely satisfactory and it is beneficial to the comfort of a patient to provide rotational movement of a headrest relative to the backrest to which it is attached. Rotatively movable headrests are shown in U.S. Pat. No. 3,817,576 (Ciavattoni), U.S. Pat. No. Re. 29,811 (Norris) and U.S. Pat. No. 3,936,091 (Rabinowitz). However, the headrests described therein also have not been entirely satisfactory. The Ciavattoni device, for example, locks the headrest only in discrete positions defined by slots in the headrest which are engaged by the pawl mechanism of the device. The positive locking mechanism is potentially dangerous in the working environment in which the headrest and chair are used. When the dental chair is placed into a reclining position, the headrest can contact various objects in the operating environment such as stools, carts and the like and subject them to damaging forces. Absent a release mechanism on the headrest, the objects so contacted may be damaged irreparably. The Norris device utilizes a cam-actuated locking mechanism having a cam surface which exerts a compressive force on a linking member to reduce the diameter of openings in which pivotable pins normally can rotate, thus preventing their rotation and the rotation of the headrest. Both forward and backward movement of the headrest relative to the backrest is prevented. Accordingly, the Norris devices exemplifies the deficiencies of the Ciavattoni device considered above. While the Rabinowitz device permits rotational movement of the headrest in the forward direction upon subjecting the headrest to forces in that direction, the cam-actuated clutch mechanism is complicated and can lead to high manufacturing costs. Furthermore, the toothed clutch mechanism can lead to premature wear if movement of the headrest is attempted without complete disengagement of the clutch members. Continuous wear can impair the positive locking mechanism and lead to slippage of the clutch members.

Accordingly, it is apparent that there is a need for a simplified articulating headrest, for use with medical and dental chairs and the like, which can be positionally varied over non-discrete positions and which provides a positive locking mechanism to prevent backward rotational movement while permitting unhindered forward rotational movement.

SUMMARY OF THE INVENTION

The articulating headrest of the present invention comprises means for mounting the headrest to the backrest of a chair, head support means pivotably attached at a first end thereof to the mounting means and being rotatively moveable forwardly and backwardly with respect to the backrest, shaft means having first and second ends, the shaft means being pivotably attached adjacent the first end thereof to the mounting means, and unidirectional locking means on the head support means for releasably engaging the shaft means over a portion of the length of the shaft means intermediate the first and second ends thereof, the locking means preventing backward rotational movement of the head support means when engaged with the shaft means and permitting forward rotational movement of the head support means when either engaged or disengaged with the shaft means.

As used herein, "engaged" means that the locking means is in contact with a portion of the shaft so as to prevent pivotal movement of the headrest in the backward direction; and "disengaged" means that the locking means does not prevent pivotable movement of the headrest in the backward direction (even though it may be in contact with the shaft during such backward movement).

Figure 1:
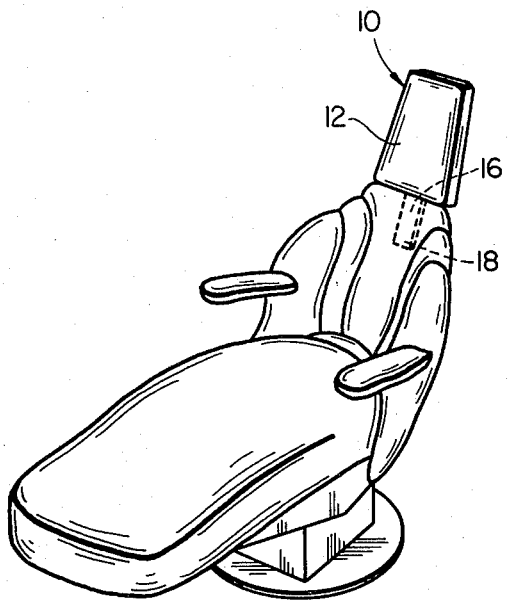
FIG. 1 is a perspective view of the headrest mounted on the backrest of a dental chair.
Figure 2:
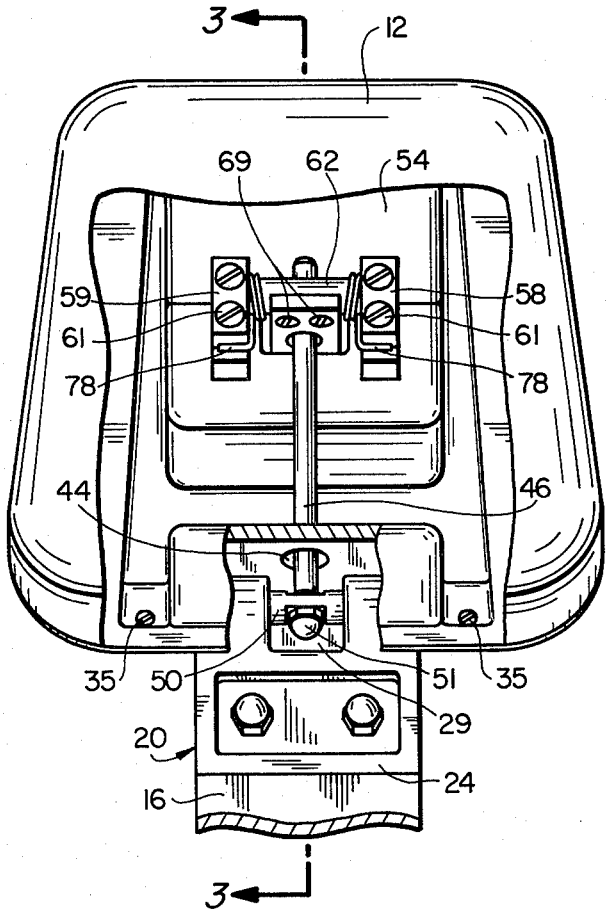
FIG. 2 is a front elevational view, partly broken away, of the headrest of FIG. 1.

Headrest 10 of the present invention is formed with a cushion 12 supported on a head support plate 14 which is pivotably attached to a chair mount 16. Chair mount 16 is formed with a shank portion 18 at one end thereof for engagement with the backrest of a dental chair and a pivot pin support 20 at the other end about which articulation of headrest 10 can occur. Pivot pin support 20 is formed with an upper section 22 and a lower section 24, having side walls 26 and 27 and a back wall 28. Section 22 of pivot pin support 20 is substantially "U"-shaped having a central opening 29 defined by the upper portions of side walls 26 and 27. Back wall 28 also has an opening therethrough which is coextensive with the opening defined by side walls 27 and 28. An opening 30 in side wall 26 and an opening 31 in side wall 27 are provided to rotatively receive a pivot pin 32 which is located in openings 33 and 34 in the side walls 39 and 40, respectively, of head support plate 14, and held therein by screws 35.

Head support plate 14 is formed with a flange 36 extending about the periphery thereof to support cushion 12, which can be fastened thereto in a conventional manner. Head support plate 14 additionally has side walls 39 and 40, back wall 41 and bottom wall 42. An aperture 44 is provided through bottom wall 42 for passage therethrough of an elongated shaft 46, which is connected at or adjacent a first end 47 to a shaft pivot pin 50 by means of a threaded nut 51. Shaft pivot pin 50 is rotatively retained in pivot pin support 20 in holes 52 and 53. Shaft 46 thus is able to rotate forwardly and backwardly on pivot pin 50 with respect to pivot pin support 20. Back wall 41 of head support plate 14 is formed with a raised portion 54, on which are provided lugs 55 and 56 for attachment of lock plate pin support 58 and lock plate pin support 59 by means of attaching screws 61.

Lock plate pin supports 58 and 59 are each provided with an aperture 60 extending through the sides thereof to rotatively receive lock plate pin 62. Lock plate pin 62 is formed with a flat surface 66 on its side which is nearest first end 47 of shaft 46. A lock plate 68 is fastened to flat surface 66 by means of attaching screws 69. Lock plate 68 extends through an aperture 71 formed in back wall 41 of head support plate 14. Spring 70 is provided to bias lock plate 68 in a direction toward first end 47 of shaft 46 and is formed with ends 78, which contact lugs 55 and 56, and an intermediate section 79 which urges lock plate 68 toward first end 47 of shaft 46. Release handle 72 is attached by means of attachment screws (not shown) to end 75 of lock plate 68 which extends outwardly through aperture 71 in back wall 41 of head support plate 14. A substantially cylindrical opening 74 is provided in lock plate 68 to receive second end 48 of shaft 46. Opening 74 is formed in lock plate 68 at an angle relative to the plane in which lock plate 68 lies. The central longitudinal axis of opening 74 parallel to inner surface 76 of opening 74 lies in the same vertical plane as the longitudinal axis of shaft 46. The angle $\alpha$ formed between the plane in which lock plate 68 lies and the longitudinal axis of opening 74 is typically between about 60°-80°, and an angle of 70° has been found to be satisfactory. Opening 74 optionally can have a relief cut on the lower semicircle of the front edge of opening 74 and a relief cut on the upper semicircle of the back edge of opening 74 to define binding edges 82 and 83, respectively. The sharply defined edges 82 and 83 facilitate positive locking of lock plate 68 on shaft 46 when in the engaged position.

Figure 3:
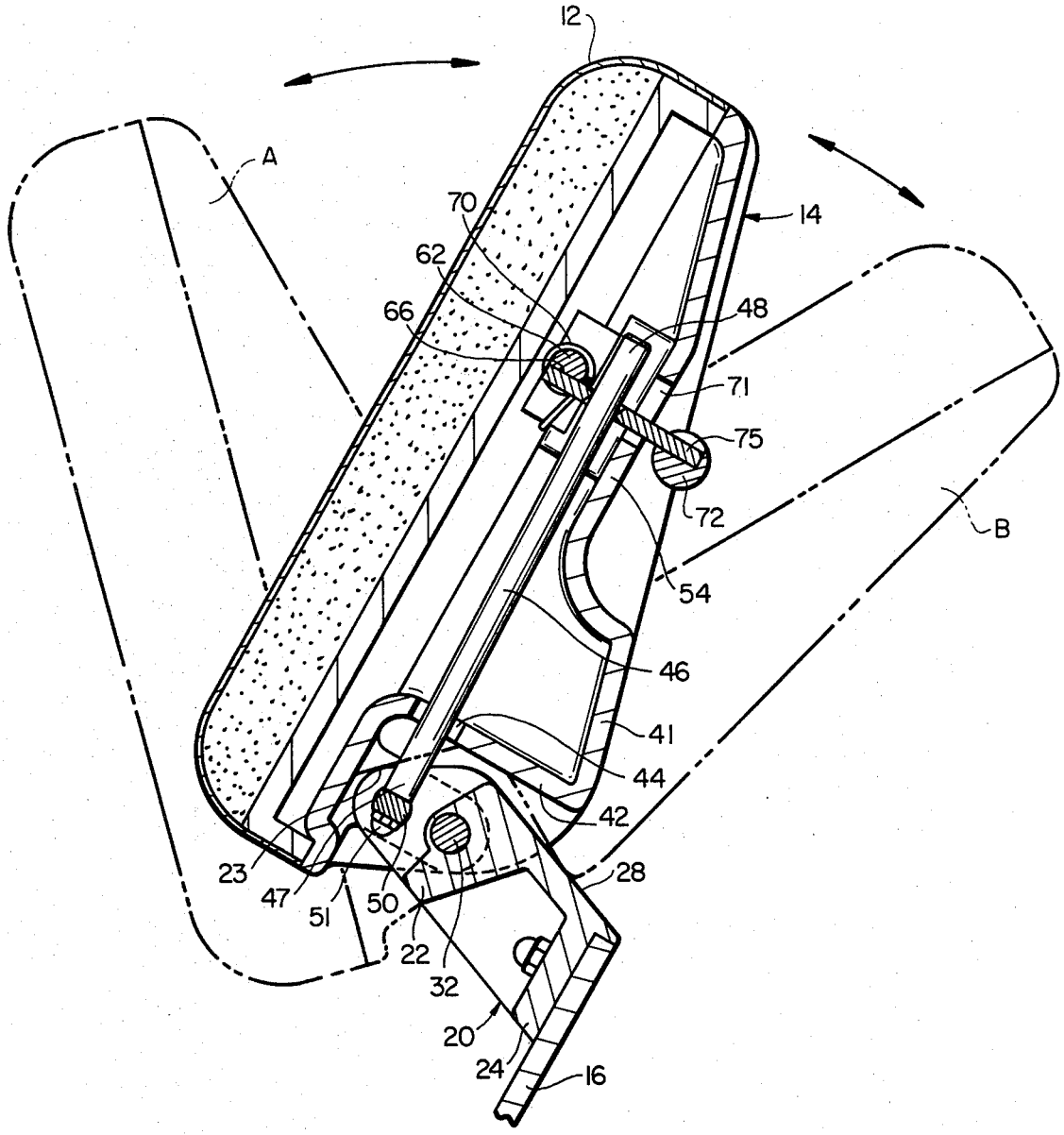
FIG. 3 is a side sectional view along line 3—3 of FIG. 2, the phantom views illustrating the extreme forward and backward positions assumable by the headrest.
Figure 4A:
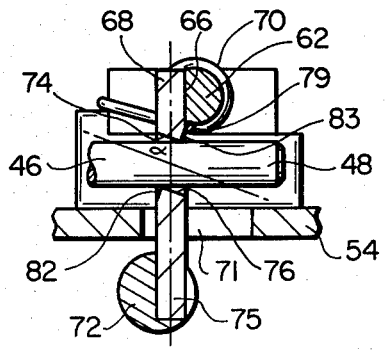
FIG. 4A is an enlarged detail view, in section, of the lock means in its lock position engaged with the shaft.
Figure 4B:
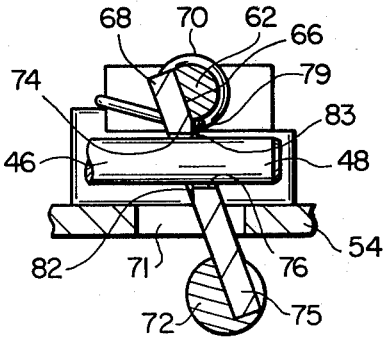
FIG. 4B is an enlarged detail view, in section, of the lock means in its released position disengaged from the shaft.
Figure 5:
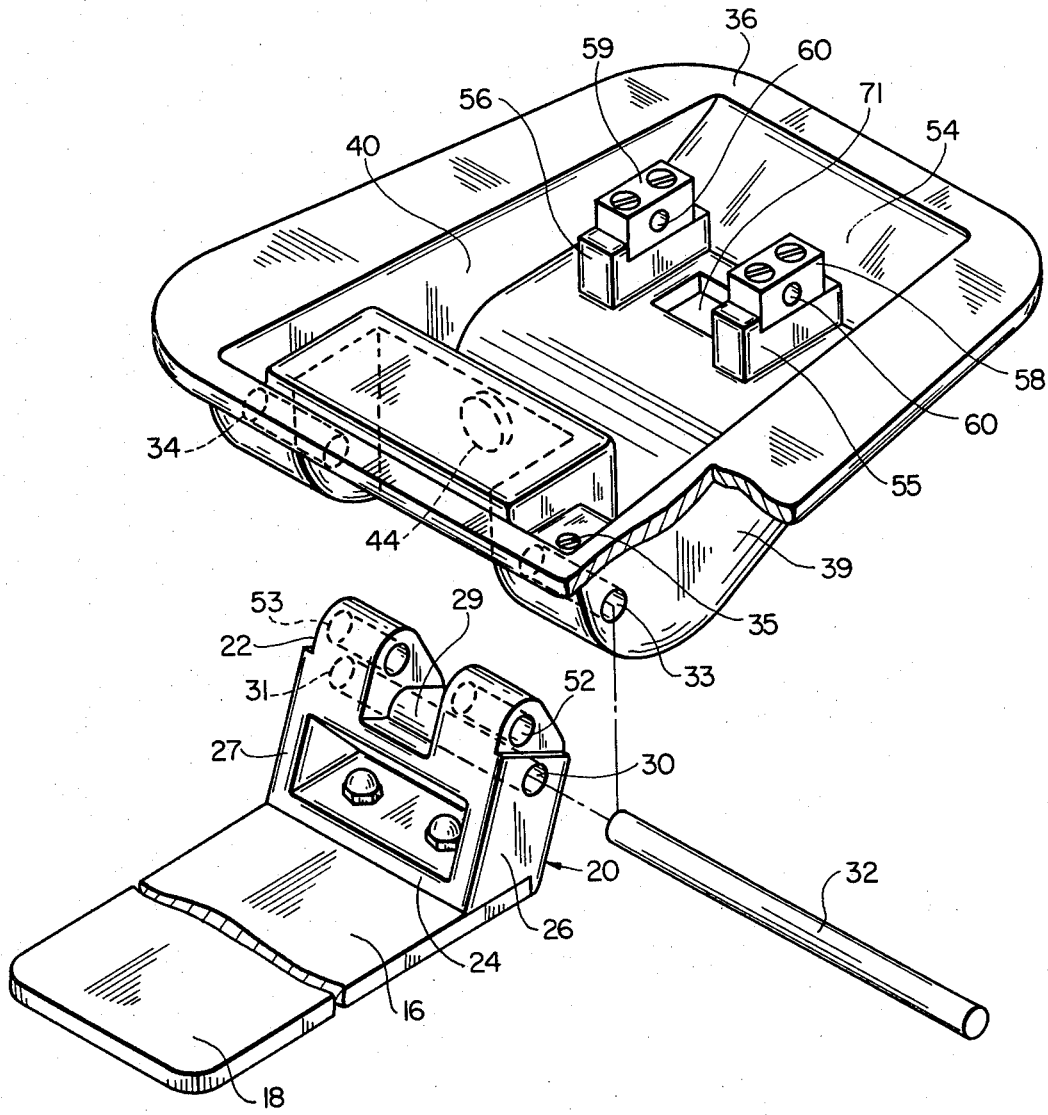
FIG. 5 is an exploded view of the head support means and mounting means of the present invention with the locking means and pivot means being removed and a portion of the head support means being broken away for clarity.

As shown most clearly by the phantom line positions in FIG. 3, headrest 10 is operable between a first position "A" in which bottom wall 42 of head support plate 14 abuts the top surface 23 of pivot pin support 20 and a second position "B" in which bottom wall 42 of head support plate 14 abuts backwall 28 of pivot pin support 20. At intermediate positions, lock plate 68 is biased by spring 70 toward a first position at which edges 82 and 83 engage the outer surface of shaft 46, as shown in FIG. 4A, to fixedly secure head support plate 14 and prevent the backward rotation thereof. In order to backwardly rotate headrest 10 through the intermediate positions, the operator grasps release handle 72 with the fingers of one hand, places the thumb of the hand on top of headrest 10 and exerts an upward and outward force force on release handle 72 to move lock plate 68 to a second position whereat the axis of opening 74 in lock plate 68 is substantially coincident with the longitudinal axis of shaft 46. As shown most clearly in FIG. 4B, alignment of the axis of opening 74 in lock plate 68 with the axis of shaft 46 disengages binding edges 82 and 83 of opening 74 from the outer surface of shaft 46, and positive pressure in a downward direction upon head support plate 14 by the operator causes rotational movement of headrest 10 about pivot pin 32. As headrest 10 pivots about pivot pin support 20 on pivot pin 32, shaft 46 pivots about pivot pin support 20 on shaft pivot pin 50 and slides over surface 76 as lock plate 68 moves axially along the length of shaft 46 toward the second end 48 thereof. Upon release of release handle 72, spring 70 urges lock plate 68 in a direction toward first end 47 of shaft 46, thereby locating lock plate 68 in its first position and causing binding edges 82 and 83 of opening 74 to again engage the outer surface of shaft 46. Downward pressure on headrest 10, such as created by a patient's head resting on cushion 12, then increases the forces at edges 82 and 83 on shaft 46 and prevents subsequent movement of headrest 10 in the backward direction.

It is an important feature of the present invention that upward pressure on headrest 10 is not resisted or prevented by the action of lock plate 68 on shaft 46 when lockplate 68 is at either its first or second position, i.e. either engaged or disengaged with the shaft. The exertion of a force on headrest 10 in a forward direction with respect to the backrest cancels the binding forces present at edges 82 and 83 of opening 74 in lock plate 68 and permits unhindered movement in the forward direction of head support plate 14 along shaft 46. That aspect of the invention is particularly important in those instances when the headrest of the present invention will be utilized on chairs which are reclineable. The reclining mechanisms of dental chairs, for example, typically are powered by electrical or hydraulic means which can exert substantial forces during the reclining movements of the chair. In the event that an object within the operating environment of the chair is contacted by the headrest during the reclining movement of the chair, excessive forces are prevented from being exerted on the object in view of the allowance of unhindered movement of the headrest in the forward direction. Absent such a provision, it is apparent that extreme forces could be exerted upon the object which is being contacted and damage could ensue. Such objects might be, for example, carts, trays, counter tops, stools and the like which are usually present within a dental office.

This aspect of the invention is particularly important in installations where "sit-down" dentistry is practiced. Typically, the dental operator is positioned near the dental chair on a stool and operates the reclining chair while so positioned. It is possible during a lapse of attention on the operator's part, that the headrest could come in contact with the leg or knee of the operator, pinning the operator between the headrest and the stool and causing injury. Such an occurrence is obviated when the headrest of the present invention is employed.

Also, it is another feature of the present invention that pivot pin 32 is located on pivot pin support 20 such that it is positionable below the nape of the neck of a patient. As head support plate 14 moves from the extreme forward position to the extreme backward position, head support plate 14 and cushion 12 will always remain under and in contact with the head of the patient. Accordingly, there is no position assumable by the headrest, even during rapid movement thereof, which will not provide adequate support for the head of a patient, and possibilities of whiplash or other trauma experienced by the patient are effectively eliminated. The aforesaid location of pivot pin 32 permits the use of a cushion having a relatively small size so as not to interfere with the dental operator's access to the patient.

Although this invention has been described with reference to dental and medical chairs and the like, it is also applicable to other chairs, for example, automobile seats, lounge chairs, furniture and the like wherein an articulating headrest can be utilized.

While this invention has been described with reference to specific embodiments thereof, it should be understood by those skilled in this art that various changes may be made and equivalents may be substituted without departing from the true spirit and scope of the invention. In addition, various novel elements, as described herein can be used individually or collectively, as desired. All such modifications are intended to be within the scope of the claims appended hereto.

What is claimed is:

1. An articulating headrest comprising:

means for mounting said headrest to a backrest of a chair, said mounting means having a top surface and a back surface;

head support means having a first, lower end and a second, top end, said head support means being pivotably attached at the first, lower end thereof to said mounting means and being rotatively movable forwardly and backwardly with respect to said backrest, said head support means including a bottom wall having a first opening therein, said bottom wall being adapted to contact said top surface of said mounting means when said head support means is at a forwardmost rotational position and adapted to contact said back surface of said mounting means when said head support means is at a backwardmost rotational position to thereby limit rotational movement of said head support means;

elongated shaft means having first and second ends, said shaft means being pivotably attached adjacent to the first end thereof to said mounting means and extending through said first opening in said bottom wall, said second end of said shaft being positioned near the second, top end of said head support means; and unidirectional locking means positioned on said head support means near the second, top end thereof for releasably engaging said shaft means over a portion of the length of said shaft means intermediate the first and second ends thereof, said locking means preventing backward rotational movement of said head support means when said locking means is engaged with said shaft means and permitting forward rotational movement of said head support means when said locking means is either engaged or disengaged with said shaft means.

2. The headrest of claim 1 wherein said locking means comprises a lock plate pivotably attached to said head support means at a position remote from said first end thereof, said lock plate having a second opening formed therein for receiving said shaft means and said lock plate being movable from a first position of engagement with said shaft means to a second position of disengagement with said shaft means.

3. The headrest of claim 2 wherein said second opening has a central axis inclined at an angle relative to the plane in which said lock plate lies.

4. The headrest of claim 3 wherein said angle of inclination is between about 60°–80°.

5. The headrest of claim 3 wherein said angle of inclination is about 70°.

6. The headrest of claim 2, 3, 4 or 5 wherein said lock plate extends through an aperture formed in said head support means and terminates outwardly of said head support means.

7. The headrest of claim 2 wherein said locking plate is biased in a direction toward the first end of said shaft means.

8. An articulating headrest comprising:

a mounting bar adapted for attachment at one end thereof to a backrest of a chair;

a first pivot pin support on the other end of said mounting bar having a top surface and a back surface, said first pivot pin support rotatively receiving a first pivot pin at a first location therein and a second pivot pin at a second location therein;

a head support plate having a first, lower end and a second, top end, said head support plate being attached at the first, lower end to said first pivot pin, said head support plate including a bottom wall having a first opening therein, said bottom wall being adapted to contact said top surface of said first pivot pin support when said head support plate is at a forwardmost rotational position and adapted to contact said back surface of said first pivot pin support when said head support plate is at a backwardmost rotational position to thereby limit rotational movement of said head support plate;

an elongated shaft having first and second ends, said shaft being attached at the first end thereof to said second pivot pin and extending through said first opening in said bottom wall, said second end of said shaft being positioned near the second, top end of said head support plate;

a further pivot pin support on said head support plate at a location spaced from said first pivot pin support and positioned near the second, top end of said head support plate, said further pivot pin support rotatively receiving a third pivot pin therein; and a lock plate attached at one end thereof to said third pivot pin, said lock plate having a second opening therethrough for receiving the second end of said shaft, said lock plate being movable from a first position of engagement with said shaft to a second position of disengagement with said shaft, whereby backward rotational movement of said head support plate is prevented when said lock plate is in said first position and forward rotational movement of said head support is permitted when said lock plate is in either said first or second position.

9. The headrest of claim 8 wherein said shaft and said second opening are substantially cylindrical, the central axis of said second opening being inclined at an angle relative to the plane in which said lock plate lies.

10. The headrest of claim 9 wherein said angle of inclination is between about 60°–80°.

11. The headrest of claim 9 wherein said angle of inclination is about 70°.

12. The headrest of claim 9 wherein the lower front edge and the upper back edge of said second opening are formed with relieved surfaces.

13. The headrest of claim 8 further comprising means biasing said lock plate toward engagement with said shaft.

14. The headrest of claim 13 wherein said biasing means comprises a spring.

* * * * *